United States Patent [19]

Ozgener

[11] 4,206,770

[45] Jun. 10, 1980

[54] TOBACCO TAMPING TOOL FOR SMOKING PIPE

[76] Inventor: Cano A. Ozgener, 830 Kendall Dr., Nashville, Tenn. 37209

[21] Appl. No.: 877,003

[22] Filed: Feb. 13, 1978

[51] Int. Cl.[2] ..... A24F 9/02

[52] U.S. Cl. ..... 131/247

[58] Field of Search ..... 131/247, 177, 184

[56] References Cited

FOREIGN PATENT DOCUMENTS 530777 7/1955 Italy ..... 131/247

7291 of 1899 United Kingdom ..... 131/247

*Primary Examiner*—Stephen C. Pellegrino

*Attorney, Agent, or Firm*—Harrington A. Lackey

[57] ABSTRACT

A tobacco tamping tool for a smoking pipe including a cylindrical hollow body and a stem having a tamping head at one end telescopingly received within said hollow body member and a spring within said hollow body member normally urging said stem and tamping head to a normally protracted position. The value of the spring is such that as said body member is manipulated to force said tamping head into the bowl of the smoking pipe to depress the tobacco therein, said spring will yield to cause said body member to move downward relative to said stem when the tobacco has been depressed to its desired compaction.

4 Claims, 2 Drawing Figures

TOBACCO TAMPING TOOL FOR SMOKING PIPE

BACKGROUND OF THE INVENTION

This invention relates to smoking articles, and more particularly to a tobacco tamping tool for a smoking pipe.

In the art of smoking tobacco in a pipe having a bowl, the degree of compaction of the tobacco affects the efficiency and enjoyment of the smoking. If the tobacco is too loose in the bowl of the pipe, excessive amounts of air and smoke pass through the loose tobacco in the bowl and the stem and into the smoker's mouth and possibly his lungs. If the tobacco is packed too tightly in the bowl of the pipe, little, if any, air and smoke can pass through the tobacco in the bowl and the pipe, even if the smoker increases his draft through the pipe stem. In some instances, when the tobacco is packed too tightly, combustion is so limited that the flame or burning tobacco becomes extinguished.

Accordingly, a pipe smoker tamps the tobacco within the bowl of the pipe with a tamper or tamping tool until the compaction of the tobacco is proper, not too loose and not too tight, to achieve the smoking efficiency and enjoyment desired by the pipe smoker.

Conventionally, the tobacco in the pipe bowl is tamped with any desired tamping tool having a tamping head and usually an elongated slender rod or stem supporting the tamping head. Nevertheless, regardless of the particular design of the tamping tool, the tamping head and stem, rod or handle are usually integral with each other to provide a rigid tamping tool. Therefore, considerable practice must be conducted by the pipe smoker to develop the degree of skill or feel in using the tamping tool to attain the desired tobacco compaction within the pipe bowl. Thus, a successful pipe smoker resorts to considerable experimentation in tamping the tobacco in the bowl before the desired smoking results are obtained.

SUMMARY OF THE INVENTION

It is therefore an object of this invention to provide a tobacco tamping tool for the bowl of a smoking pipe requiring little or no experimentation or practice on the part of the pipe smoker to achieve the optimum compaction of the tobacco in the pipe bowl.

Such optimum results are obtained by providing a hollow body member having an elongated cylindrical chamber with an opening in its remote end for telescopingly receiving an elongated stem. One end of the stem terminates in a tamping head having a cross-section slightly smaller than the cross-section of the bowl of the pipe into which the tamping head is to be introduced. The opposite end of the stem is received within the chamber of the body member.

An elongated coil spring is received within the chamber between the opposite closed end of the chamber and associated with the stem to normally urge the stem outward through the chamber opening to a normal protracted position. In a preferred form of the invention, the normal protracted position of the stem is determined by stop means between the stem and the chamber. In a preferred form of the invention, the stop means includes an annular shoulder extending circumferentially around the exterior surface of the stem and adapted to engage an axially aligned annular abutment flange, preferably located radially adjacent the chamber opening.

The selection of the coil spring within the chamber is important since the value of the spring must be such that as the body member is manipulated to force the tamping head down into the bowl to compress the tobacco, the spring will yield to permit the commencement of retraction of the stem within the chamber of the body member when the tobacco has been compacted or compressed to its desired density. Thus, the pipe smoker has a positive and clearly visible indicator of the desired compaction of the tobacco, without restoring to lengthy experimentation with a rigid tobacco tamping tool.

DESCRIPTION OF THE PREFERRED EMBODIMENT

Figure 2:
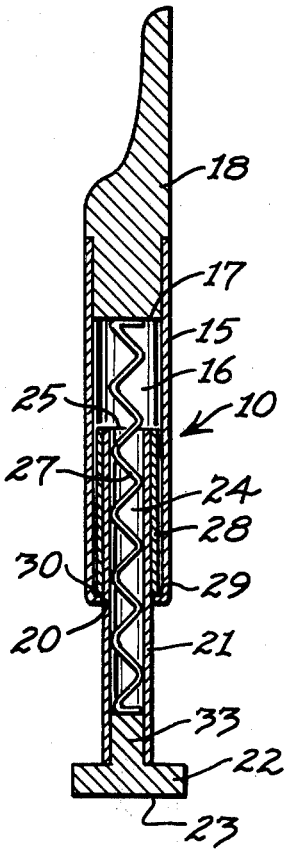
FIG. 2 is a section taken along the line 2—2 of FIG. 1 of the tamping tool.

Referring now to the drawings in more detail, the tobacco tamping tool 10 made in accordance with this invention is designed to tamp tobacco 11 within the bowl 12 of a smoking pipe 13 having a pipe stem 14.

The tool 10 includes an elongated, cylindrical body member 15, hollow inside to define a chamber 16. The upper end of the chamber 16 is closed by an end wall 17 which may form the lower surface of a plug or cap 18 of any desired configuration. The lower end of the body member 15 is provided with a central aperture or opening 20 for coaxially and telescopingly receiving a tamper stem 21. The lower end portion of the tamper stem 21 terminates in a tamping head 22, preferably circular or disc-shaped having a smooth, and preferably flat, bottom surface 23. The cross-section of the opening 20 is similar in shape to the cross-section of the tamping stem 21, and slightly larger, so that the tamping stem 21 is free to move reciprocably and coaxially of the body member 15.

The tamping stem 21 is also preferably hollow to comprise a spring chamber 24 having an upper open end 25 for receiving the lower end portion of a coil spring 27. The upper end of the coil spring 27 preferably abuts the upper end wall 17 of the chamber 16.

In order to limit the outward, or downward, movement of the tamping stem 21 relative to the body member 15, an annular sleeve 28 is fixed to and surrounds the outer surface of the upper portion of the tamping stem 21 to form an annular lower shoulder 29. The annular shoulder 29 is coaxially in alignment with an annular abutment flange 30 defined by the bottom end wall of the body member 15 radially adjacent the opening 20. The abutment of the annular shoulder 29 against the annular flange 30 limits the outward or protracted position of the tamping head 22, relative to the body member 15.

Figure 1:
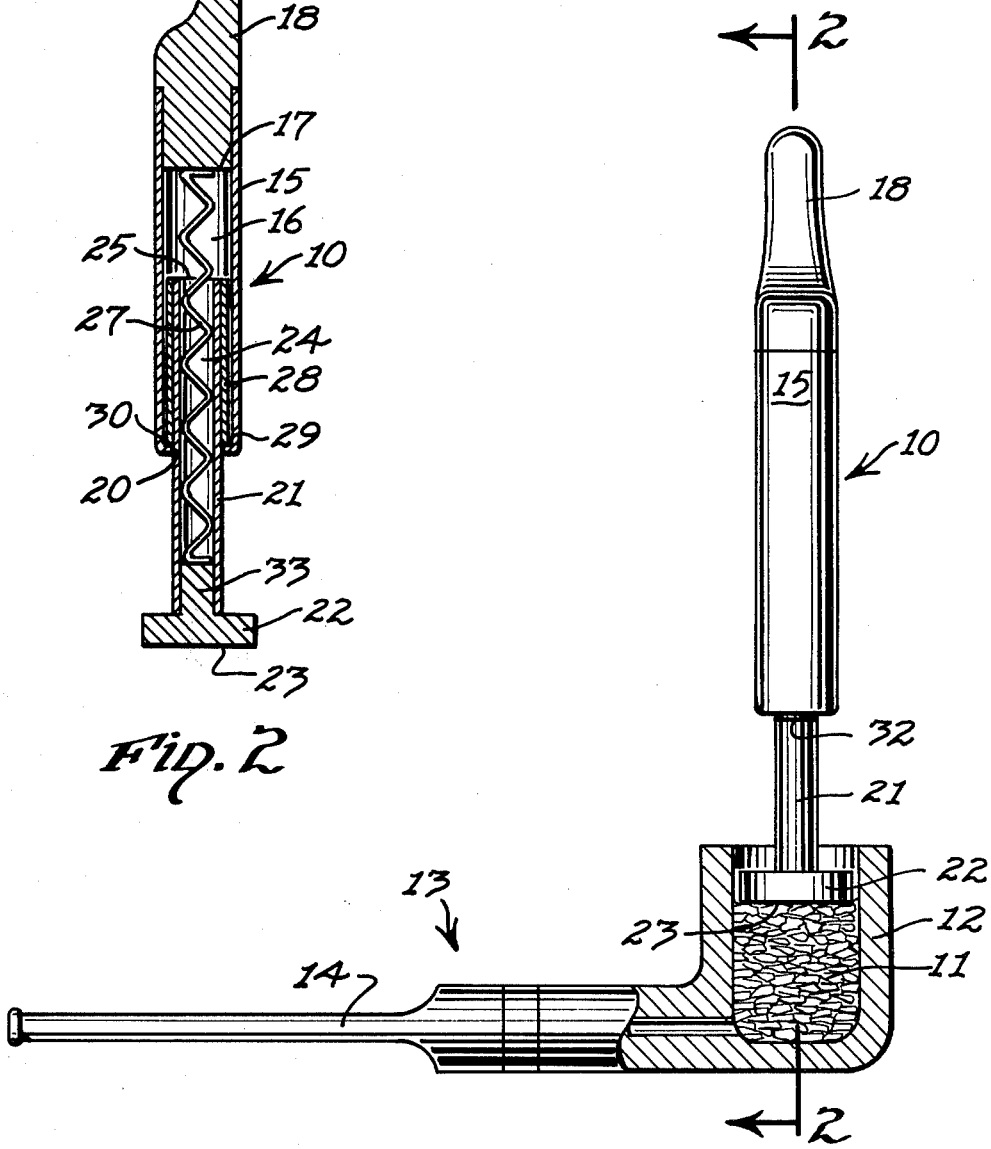
FIG. 1 is a side elevation of the tobacco tamping tool in operative position within the bowl, shown in section, of a smoking pipe.

The value and length of the coil spring 27 are such that the tamping head 22 will be normally retained in its protracted position as disclosed in FIGS. 1 and 2.

In the operation of the tamping tool 10, the smoker first introduces the tobacco 11 into the bowl 12 of the pipe 13 to the desired level, so that the tobacco 11 is in a loose condition within the bowl 12. The smoker then grasps the tool 10 by the body member 15 and lowers it to introduce the tamping head 22 substantially concentrically within the bowl 12. The smoker pushes the body member 15 down, causing the tamping head 22 also to move down with body member 15 gradually pressing down upon the tobacco 11, to compact the tobacco 11 into a more dense mixture.

The value of the spring 27 is such that when the tobacco 11 has attained its desired compaction of density, its resistance to the downward movement of the tamping head 22 will exceed the force of the spring 27, causing the spring 27 to yield, and simultaneously causing the body member 15 to move downward relative to the stem 21. If the value of the spring 27 has been selected to yield when the tobacco 11 has been compacted to its desired density, then the pipe smoker will immediately know the desired compaction has been attained, either by the feel of the body member 15 moving downward relative to the stem 21, or by observting the relative movement between the body member 15 and the stem 21.

In the preferred use of the tamping tool 10, the smoker will push the tamping head 22 down into the bowl 12, compressing the loose tobacco, without any deflection of the stem 21 within the body member 15, for about the first one-third of the total vertical travel of the tamping head 22. The value of the spring 27 is such that the tamping head 22 exerts about 2 p. s. i. of pressure upon the loose tobacco.

For the second one-third of the vertical travel, the stem 21 will undergo approximately one-half of its ultimate deflection within the body member 15, while exerting a pressure upon the compacted tobacco of approximately 5–8 p.s.i.

For the final one-third of the vertical travel of the tamping head 22, the tamping head will exert a pressure greater than 8 p.s.i., and at the end of its travel it will be fully deflected within the body member 15. The term "full deflection" does not necessarily mean that the upper end 25 of the tamping stem 21 will abut the upper end wall 17 of the chamber 16. Full deflection is equated with the extent of vertical movement of the stem 21 within the chamber 16 when the tamping head 22 has attained the depth of its full vertical travel within the bowl 12, to fully compress the tobacco 11.

The tamping tool 10 may also be used to extinguish the burning tobacco, by depressing the tool 10 so that the tamping head 22 attains approximately one-half of its full deflection within the bowl 12.

If desired, an indicator mark or band 32 (FIG. 1) may be formed or imprinted upon the exterior surface of the stem 21 adjacent the bottom end of the body member 15, to facilitate visual indication of the relative movement between the tool parts 15 and 21, which in turn indicates the desired density of the tobacco 11 within the bowl 12.

The tamping head 22 may be formed as shown in FIG. 2, having an upper plug end 33 adapted to be press-fitted within the lower open end portion of the hollow tamping stem 21. The shoulder sleeve 28 may be press-fitted or glued upon the outer surface of the upper portion of the stem 21, while the plug 18 may be press-fitted within the upper open end of the cylindrical body member 15.

As disclosed in the drawings, the plug member 18 may be formed to have the exterior shape of a pipe scraping tool, which may be inserted into the bowl 12 for removing the ashes from the bowl 12 after the smoking has been completed.

The relative dimensions between the parts of the tool 10 may vary without affecting the nature of the invention, so long as the relative parts 15 and 21 are adapted to move relative to each other after the force of the spring 27 has been overcome, and so long as the tamping head 22 is adapted to fit within the bowl 12 of the particular pipe 13 for which tamping of the tobacco 11 is desired.

What is claimed is:

1. A tobacco tamping tool for a smoking pipe having a tobacco-receiving bowl of predetermined cross-section comprising:

(a) a body member having an elongated cylindrical chamber normally vertical in operative position, (b) said cylindrical chamber having an upper closed end wall and an opening in the lower end of the said chamber, (c) an elongated stem having upper and lower end portions, (d) said lower end portion terminating in a tamping head having a cross-section slightly less than the cross-section of the bowl of a smoking pipe into which said tamping head is adapted to enter to tamp tobacco, (e) said stem extending through said opening so that said upper end portion is telescopingly received wholly within said chamber for longitudinal reciprocable movement relative to said body member, (f) spring means within said chamber urging said stem longitudinally downward through said opening to a normally protracted position, and (g) the value of said spring means being such that when said tamping head enters the bowl of a pipe to tamp tobacco within said bowl and said tamping head has depressed said tobacco to the desired compaction, said spring means will yield to permit said stem to retract within said chamber.

2. The invention according to claim 1, in which said spring means comprises an elongated coil spring having upper and lower ends, said upper end of said spring abutting the closed end wall of said chamber and said lower end of said spring urging said stem to its protracted position.

3. The invention according to claim 1 further comprising a shoulder on the exterior surface of the upper end portion of said stem and an abutment flange within said chamber and radially adjacent said chamber opening and in longitudinal alignment with said shoulder for engagement with said shoulder when said stem is in its normally protracted position.

4. The invention according to claim 1 in which said tamping head is annular and has a substantially flat, smooth bottom surface.

* * * * *